US005485997A

United States Patent [19]

Schmidt et al.

[11] Patent Number: 5,485,997

[45] Date of Patent: *Jan. 23, 1996

[54] GOLF PUTTER HEAD WITH FACE PLATE INSERT HAVING HEIGHTENED MEDIAL PORTION

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The term of this patent shall not extend beyond the expiration date of Pat. No. 5,282,625.

[21] Appl. No.: 323,892

[22] Filed: Oct. 17, 1994

Related U.S. Application Data

[63] Continuation-in-part of Ser. No. 267,885, Jul. 7, 1994, and a continuation-in-part of Ser. No. 286,275, Aug. 15, 1994, which is a continuation of Ser. No. 161,592, Dec. 6, 1993, abandoned, which is a continuation of Ser. No. 999,249, Jan. 19, 1993, abandoned, which is a continuation-in-part of Ser. No. 921,857, Aug. 5, 1992, Pat. No. 5,282,625.

[51] Int. Cl.[6] ..... A63B 53/04

[52] U.S. Cl. ..... 273/78; 273/167 H; 273/167 J; 273/173

[58] Field of Search ..... 273/167–175, 273/164.1, 77 R, 77 A, 193 R, 194 R, 78, 79

[56] References Cited

U.S. PATENT DOCUMENTS

| | | |
|---|---|---|
| D. 228,355 | 9/1973 | Penna . |
| D. 234,209 | 1/1975 | Bizovi . |
| D. 245,441 | 8/1977 | Middlestadt . |
| D. 247,383 | 2/1978 | Adkins . |
| D. 248,181 | 6/1978 | Cervantes . |
| D. 257,784 | 1/1981 | Forys et al. . |
| D. 303,132 | 8/1989 | Muta . |
| D. 321,920 | 11/1991 | Parente et al. . |
| 922,444 | 5/1909 | Youds . |
| 1,485,685 | 3/1924 | McMahon . |
| 2,661,952 | 12/1953 | Jackson . |
| 3,134,596 | 5/1964 | Boznos . |
| 3,218,072 | 11/1965 | Burr . |
| 3,333,854 | 8/1967 | White . |
| 3,843,122 | 10/1974 | Florian . |
| 3,847,399 | 11/1974 | Raymont . |
| 3,989,248 | 11/1976 | Campau . |
| 4,121,832 | 10/1978 | Ebbing . |
| 4,199,144 | 4/1980 | Skelly . |
| 4,252,262 | 2/1981 | Igarashi . |
| 4,398,965 | 8/1983 | Campau . |
| 4,420,156 | 12/1983 | Campau . |
| 4,534,564 | 8/1985 | Yamada . |
| 4,679,792 | 7/1987 | Straza et al. . |
| 4,695,054 | 9/1987 | Tunstall . |
| 4,740,345 | 4/1988 | Nagasaki et al. . |
| 4,811,950 | 3/1989 | Kobayashi . |
| 4,848,747 | 7/1989 | Fujimura et al. . |
| 4,854,581 | 8/1989 | Long . |
| 4,884,812 | 12/1989 | Nagasaki et al. . |
| 4,928,972 | 5/1990 | Nakanishi et al. . |
| 4,957,294 | 9/1990 | Long . |
| 4,964,640 | 10/1990 | Nakanishi et al. . |

(List continued on next page.)

FOREIGN PATENT DOCUMENTS

| | | |
|---|---|---|
| 53-15412 | 5/1978 | Japan . |
| 37178 | 1/1991 | Japan . |

OTHER PUBLICATIONS

"Some of Our Best Friends are Hookers and Pushers", Golf World, Jan. 1974, p. 45.

*Primary Examiner*—Sebastiano Passaniti
*Attorney, Agent, or Firm*—William W. Haefliger

[57] ABSTRACT

In a putter head, the combination including a longitudinally elongated putter body in the form of a bar having a forward face for striking a golf ball, and rear side, top and bottom walls, a toe and a heel, between peripherally weighted toe and heel regions; a main recess sunk forwardly in the rear side; and an undercut recess extending outwardly from the inner extent of the main recess whereby a reduced thickness plate is formed between the recesses and the front face. A body face plate insert has a relatively heightened medial portion and two oppositely extending end portions of relatively reduced height.

38 Claims, 3 Drawing Sheets

U.S. PATENT DOCUMENTS 4,995,609 2/1991 Parente et al. .
5,016,882 5/1991 Fujimura et al. .
5,026,056 6/1991 McNally et al. .
5,046,733 9/1991 Antonious .
5,067,711 11/1991 Parente et al. .
5,078,398 1/1992 Reed et al. .
5,083,778 1/1992 Douglass .
5,154,425 10/1992 Niskanen et al. .
5,176,384 1/1993 Sata et al. .
5,193,805 3/1993 Solheim .
5,197,737 3/1993 Desbiolles et al. .
5,282,625 2/1994 Schmidt et al. .
5,290,036 3/1994 Fenton et al. .
5,301,946 4/1994 Schmidt et al. .
5,409,229 4/1995 Schmidt ..... 273/78

FIG. 7.
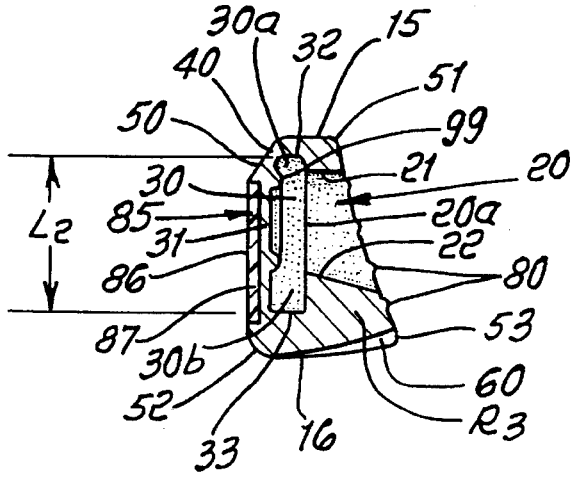
FIG. 6.
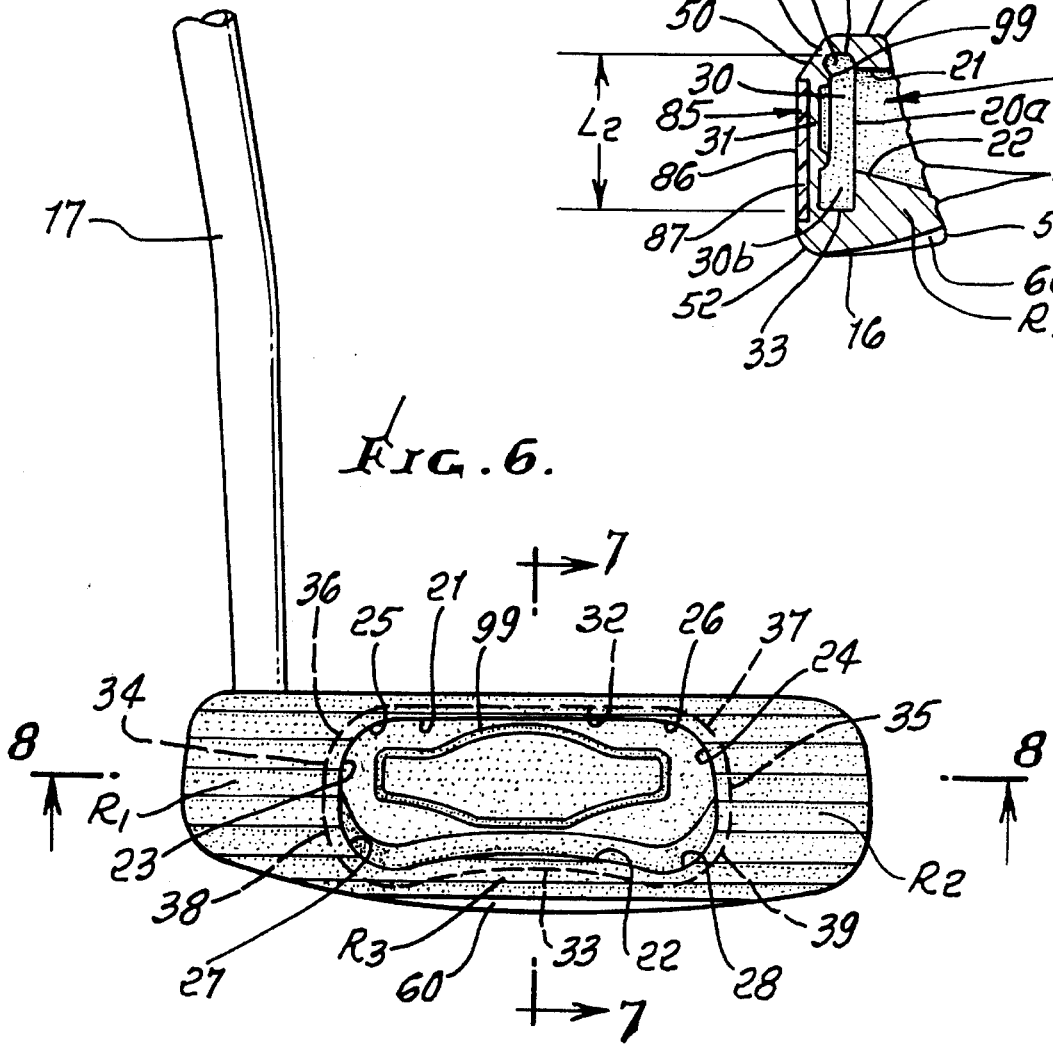
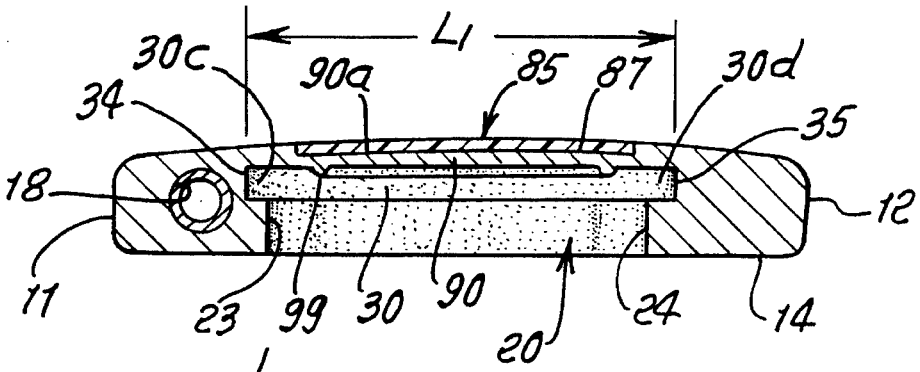
FIG. 8.

GOLF PUTTER HEAD WITH FACE PLATE INSERT HAVING HEIGHTENED MEDIAL PORTION

This application is a continuation-in-part of Ser. No. 08/267,885 filed Jul. 7, 1994, and a continuation-in-part of Ser. No. 08/286,275 filed Aug. 15, 1994; which is a continuation of Ser. No. 08/161,592 filed Dec. 6, 1993, abandoned; which is a continuation of Ser. No. 07/999,249 filed Jan. 19, 1993, abandoned; which is a continuation-in-part of Ser. No. 07/921,857 filed Aug. 5, 1992, now U.S. Pat. No. 5,282,625 issued Feb. 1, 1994.

BACKGROUND OF THE INVENTION

This invention relates generally to the construction and configuration of golf putters, and particularly putter heads. It concerns substantial improvements in face plate construction facilitating use of the putter, as well as improvements in overall putter construction and configuration.

There is need for putters having improvements in peripheral weighting combined with enlarged sweet spots and which facilitate improved results, as disclosed herein. Also, there is need for putters having face plate inserts, as for example of nonmetallic composition providing enlarged sweet spots.

SUMMARY OF THE INVENTION

It is a major object of the invention to provide an improved golf putter, and particularly a putter head incorporating unusual advantages in construction and mode of operation, as well as meeting the needs referenced above. Basically, the putter head comprises, in combination:

a) a putter body having a heel, toe, and sole defining a bottom wall, and a front wall, the body elongated between the heel and toe, and b) the body having at least one recess originating from a rear portion of the putter body and projecting forwardly toward a plane defined by the front wall, c) the body having a second recess sunk in the front wall, there being a face plate which is nonmetallic and is received in the second recess and bonded to the body, the plate having a forward surface and the second recess extending rearwardly from a plane defined by the forward surface, the plate having a relatively larger height medial portion and relatively lesser height opposite end portions projecting toward the heel and toward the toe.

As will be seen, the face plate opposite end portions typically have upper and lower edges which extend away from the enlarged medial portion, which forms an enlarged ball striking sweet spot, the plate opposite end portion also enlarging the sweet spot, and acting to enhance peripheral weighting effect of metal at the toe and heel. The face plate may consist essentially of a material, such as an elastomer, a synthetic resin, or glass; and it may be transparent, for visual observation of insignia internally of the head.

A further object is to provide the head with an undercut recess extending outwardly from inner extent of the main recess, whereby a reduced thickness plate is formed between the main and undercut recesses and the front face of the head.

As will appear, the undercut recess typically extends outwardly toward at least two of the following:

i) the top wall ii) the bottom wall iii) the toe iv) the heel;

and it preferably is loop shaped and extends outwardly toward all four of the above i) through iv).

Accordingly, the sweet spot area of the thin front wall is substantially enlarged, and peripheral weighting is provided, particularly at the toe and heel of the head, for enhanced ball contact and stroking accuracy. Also, the front wall insert plate being of nonmetallic material is of lesser density than metal, whereby added metal may be incorporated toward the heel and toe for enhanced twist resistance.

A further object is to provide bottom wall rearward projection below the main recess, in such manner as to lower the center of gravity of the head, for enhanced ball contact. In addition, the bottom wall typically defines a relatively large scoop located centrally of the head between the head and toe, the scoop diverging toward the head rear side, and spaced rearwardly from its forward face. The large scoop is typically in the form of a bevel which intersects an outwardly convex elongated corner formed between the bottom wall and the rear side of the head. That rear side is typically angled downwardly and rearwardly, to provide a downwardly visible centered intersection of the main recess with the angled rear side. As a result, the player can view the rearward extend of the main recess as well as the elongated lowermost extent of the rear side of the head, for more accurately aligning the head with the ball during putting. The construction and configuration of the face plate insert compensate for some misalignment of the head and ball, during stroking.

A still further object comprises forming the body to have outwardly convex elongated corners between at least two of the following:

i) the top wall and forward face ii) the top wall and rear side iii) the bottom wall and forward face iv) the bottom wall and rear side.

All four corners are typically made convex and longitudinally parallel, as viewed downwardly by the golfer, while tilting the head during ball address on the green, for enhanced alignment purposes as respects the head and the ball. Such tilting enables centered alignment of the face plate and ball during ball address.

These and other objects and advantages of the invention, as well as the details of an illustrative embodiment, will be more fully understood from the following specification and drawings, in which:

DRAWING DESCRIPTION

FIG. 6 is a rear view thereof;

FIG. 7 is a sectional view taken on lines 7—7 of FIG. 6; and

FIG. 8 is a sectional view taken on lines 8—8 of FIG. 6.

DETAILED DESCRIPTION

Figure 1:
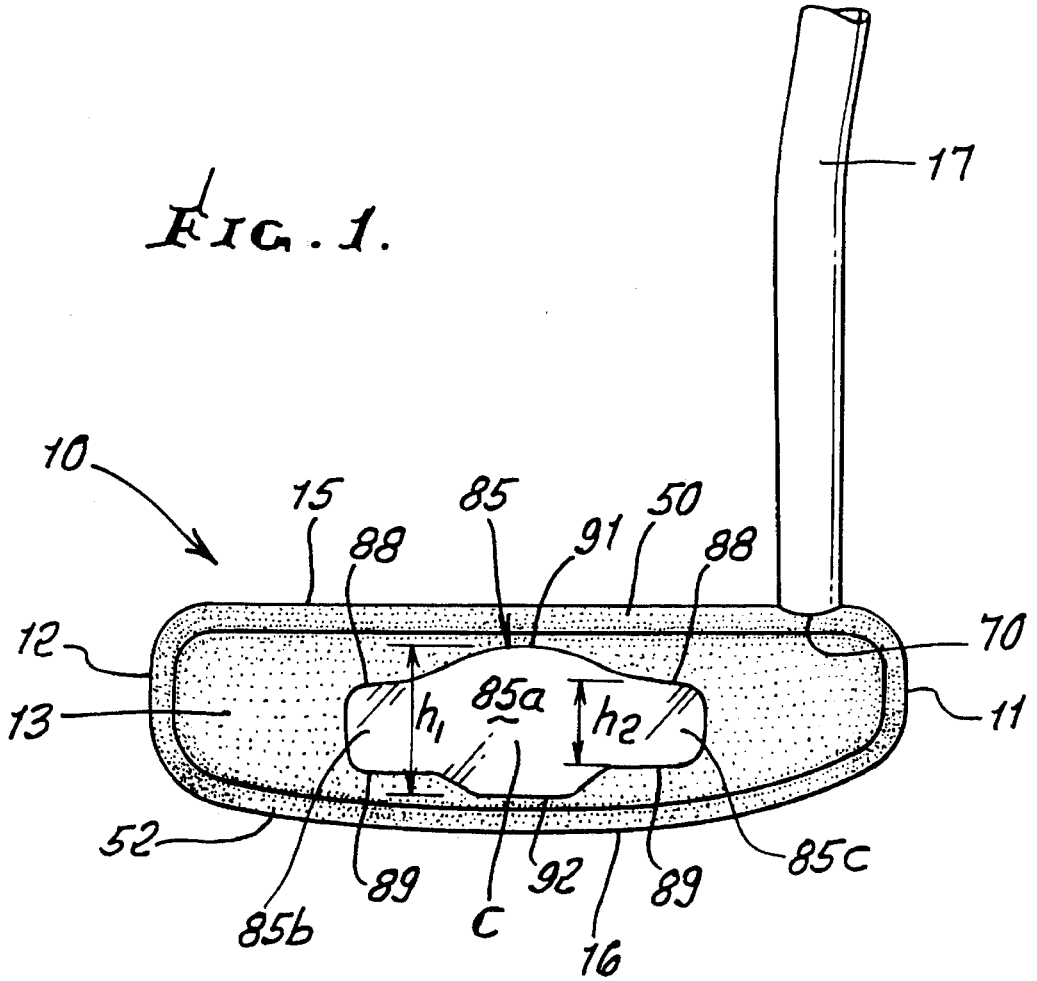
FIG. 1 is a front face view embodying our new putter head.

In the drawings, the putter head 10 has generally bar form, and may consist of metal, an example being brass. The head is longitudinally elongated between the heel 11 and toe 12, and has a front face 13, a concave rear side 14, a top wall or surface 15, and bottom wall or surface 16. See striations 80 extending in parallel relation directionally toward the heel and toe, on side 14. A putter shaft 17 extends upwardly from the top surface 15 near the heel, with curvature as shown; and typically, a bore 18 extends between the top and bottom surfaces 15 and 16 near the heel and receives the lowermost portion of the shaft. The shaft may be adhered to the bore wall, as via an adhesive such as epoxy.

A main recess 20 is sunk in the head rear side 14 to extend forwardly, as for example is seen in FIGS. 6–8. Recess 20 has top and bottom walls 21 and 22 angled and curved as shown in FIG. 6 end walls 23 and 24, concave corner walls 25–28 connecting the top wall 21 to end walls 23 and 24, and connecting bottom wall 22 with those end walls, as shown. The bottom wall is upwardly convex toward the recess 20, throughout the major extent of its length, recess 20 being longitudinally elongated as shown in FIG. 6.

An undercut recess 30 extends outwardly from the inner extent 20*a* of the main recess, whereby a reduced thickness plate 31 is formed between front face 13 and the recesses 20 and 30. The undercut recess 30 has a top elongated portion 30*a*, and a bottom elongated portion 30*b*, respectively, extending outwardly toward top wall 15 and bottom wall 16. The undercut recess also has end portions 30*c* and 30*d*, respectively, extending outwardly (relative to the main recess) toward the heel 11 and toe 12. The recess 30 has elongated top and bottom walls 32 and 33, end walls 34 and 35, and concave interior corner walls 36–39 connecting top wall 32 to end walls 34 and 35, and connecting bottom wall 33 with those end walls, as shown. A web 40 is formed between 15 and 32, as seen in FIG. 7.

The looping undercut recess enlarges the area of the sweet spot effect provided by plate 31 and by an insert plate 85, to be described. Plate 31 has length $L_1$ seen in FIG. 8, and plate height $L_2$ in FIG. 7. The head is thereby peripherally weighted in the regions $R_1$ and $R_2$ near the heel and toe, to resist twist of the shaft when the head strikes the golf ball during putting, especially when longer putts are required. Also, the center of gravity of the head is lowered by concentrating head mass in the longitudinally elongated lower region $R_3$ below the elongated recesses 20 and 30.

Region $R_3$ is located to project rearwardly of undercut recess lower portion 30*b*, and also below the main recess 20, as is clear from FIG. 6. The vertical thickness of region $R_3$ is at a maximum at the center of the head, i.e., at the section of FIG. 7; and that thickness gradually reduces in directions from the center toward the toe and heel, as is clear from FIG. 6. Therefore, weight is concentrated by region $R_3$ at the lowered center of gravity. Such lowering of the center of gravity, together with peripheral weighting at the toe and heel, as referred to above, serve to minimize inaccuracies in ball directional control during putting that might arise when the ball is struck by a portion of the head spaced away from the center C of the striking face.

The head body forms outwardly convex or beveled elongated corners between at least two of the following:

i) the top wall and the forward face (see convex corner 50 in FIG. 7), ii) the top wall and the rear side (see elongated corner 51), iii ) the bottom wall at the front face (see elongated corner 52), iv) the bottom wall and the rear side (see elongated corner 53).

Preferably, three or all four such corners are provided, whereby corners 50, 51 and 53 assist the player in visually aligning the head normal to the plane of FIG. 7; and corner 52 also assists in the same manner when the head is tilted rearwardly during addressing of the ball, as well as assisting the head to slide or sled over the green turf during club swinging. Corners 50, 51 and 53 can be seen as the player looks downwardly at the head, corner 53 projecting rearwardly of corner 51 in upwardly projected view as seen by the golfer's eye; and they appear to provide three parallel lines, for enhanced alignment effect purposes.

Figure 5:
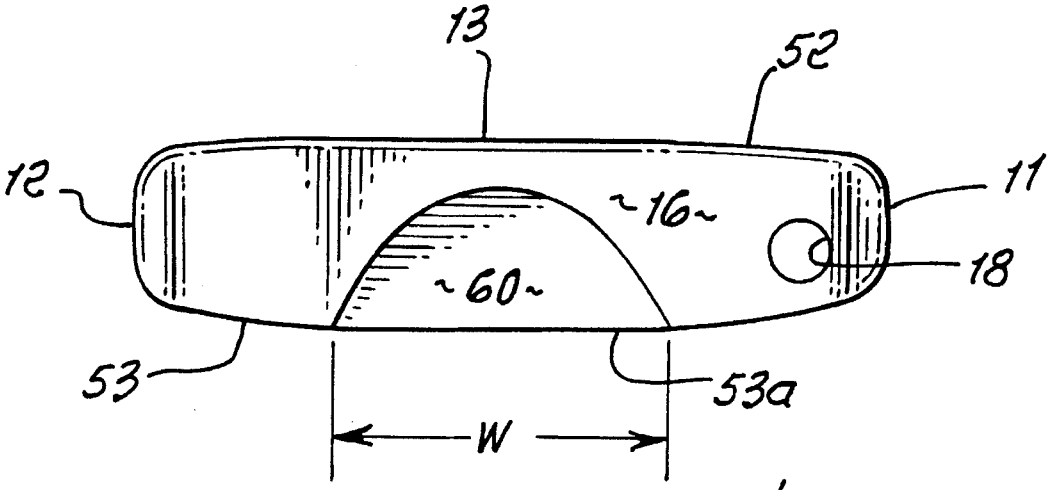
FIG. 5 is a bottom plan view thereof.

The eased sliding or sledding effect aided by corner 52 is also enhanced by provision of an enlarged "cutout" or scoop 60 at the bottom center of the head, as seen in FIG. 5. That scoop centrally intersects elongated convex corner 53, as seen in FIGS. 6 and 7, and provides a shortened and sharper lower line 53*a* at the center of the head, to enhance the visual zones to be aligned with the ball. The scoop or bevel also reduces the possibility of drag-inducing engagement of the head bolt rear with the turf as the head moves forwardly immediately after impact with the ball. The width "w" of the scoop is between 60% and 80% of $L_1$; and its forward maximum dimension in FIG. 5 is at least ⅔ the overall forward-to-rearward dimension of bottom wall 16.

Figure 2:
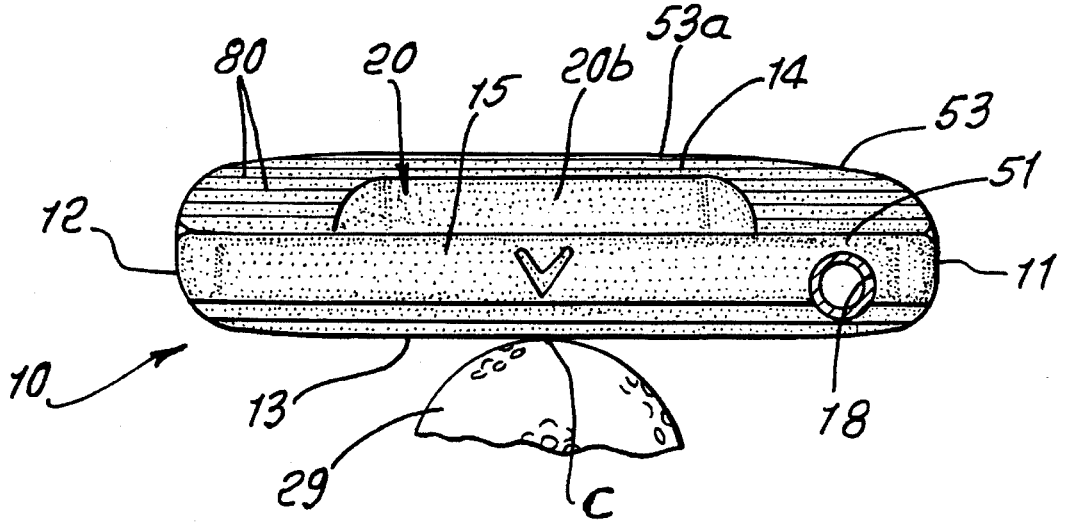
FIG. 2 is a top plan view thereof.
Figure 3:
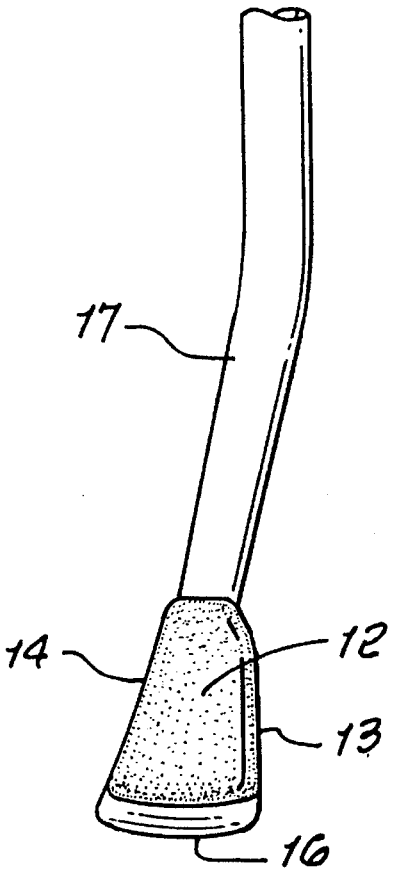
FIG. 3 is a toe end view thereof.
Figure 4:
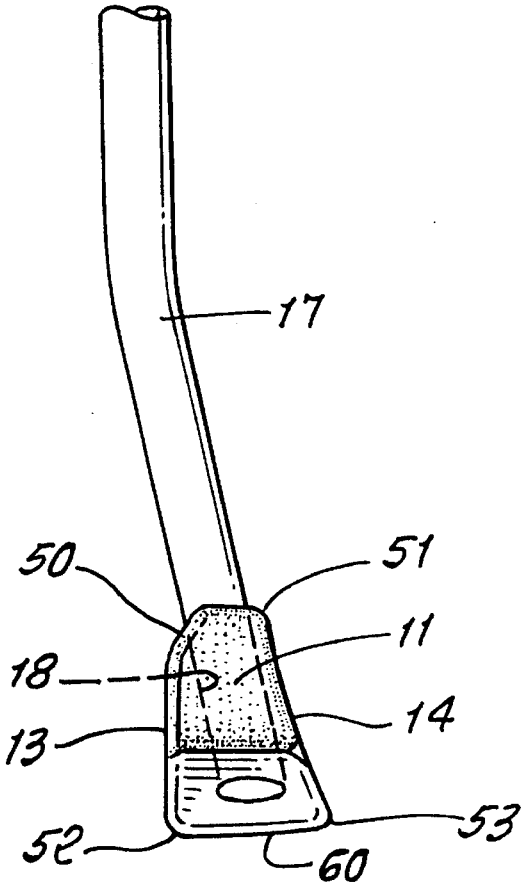
FIG. 4 is a heel end view thereof.

FIG. 2 shows the player's downward view of the rearward centered extent 20*b* of the main recess, during alignment with a golf ball 20. That rearward extent 20*b* intersects the downwardly and rearwardly slanting rear side of the head. Visibility of 20*b* also assists such centering alignment of the head with the golf ball. The bottom wall or sole 16 is downwardly shallowly convex between the toe and heel, as seen in FIG. 1, to minimize the chance of bottom wall engagement with the turf at locations spaced away from the bottom center 80 of the head, during the swing of the putter.

In FIG. 2, the shaft-receiving bore 18 has a top portion shown as intersecting flat top wall 15, and upper elongated bevel or convex corner 50, near heel 11. A scallop line is formed at 70 in FIG. 1, where bore 18 intersects bevel 50. Bore 18 may intersect only top wall 15, to eliminate line 70.

Referring now to FIGS. 1, 7, and 8, it will be seen that the head 10 includes the face plate insert 85 having a forward face 86 for striking the golf ball, as during putting. The face plate is typically nonmetallic and received in a third recess 87 formed in (sunk rearwardly in) front plate 31, as shown. Recess 87 has walls conforming to and closely fitting the periphery of the face plate insert 85 and is typically adhesively bonded to that periphery.

The face plate insert is seen to have a relatively larger height medial portion 85*a*, defining an enlarged sweet spot to strike the wall; also, the face plate insert is seen to have two relatively lesser height oppositely projecting end portions 85*b* and 85*c* projecting toward the toe and heel areas of the head 10. The end portions 85*b* and 85*c* have substantially equal height dimensions "$h_2$" along their major lengths, those dimensions being substantially less than the maximum height dimension "$h_1$" of the medial portion 85*a*. Also, the insert end portions 85*b* and 85*c* have upper and lower edges 88 and 89, which extend in parallel or substantially parallel relation, as shown.

If the ball is struck by the face plate insert, which is nonmetallic, the sound of such striking can usually be detected as being somewhat different from the sound of the ball striking the metallic area of the front face bounding the insert, whereby the player can gain accuracy in stroking of the putter by audible sensing. In this regard, the nonmetallic composition of the insert is typically an elastomer, or a synthetic resin (as for example PVC), or glass. A glass insert permits visual observation of indicia in the front face 90*a* of the reduced thickness metal wall 90 directly rearwardly of the insert. Note that the insert typically has uniform thickness; and its medial portion 85*a* has an upwardly convex edge 91 extending above the levels of portions 85*b* and 85*c*, and a downwardly convex edge 92 extending below the levels of insert end portions 85*b* and 85*c*.

The density of the face plate may be less than that of the head metal, whereby more head metal can be concentrated toward the heel and toe for increased twist resistance during putting.

FIGS. 6–8 show the provision of a looping ridge 99 protruding rearwardly from plate 31, rearwardly of insert plate 85, and toward recess 20, for bounding an escutcheon attached to plate 31. The overall boundary shape of ridge 99 conforms to the overall boundary shape of plate 85.

We claim:

1. A golf putter for use with a putter shaft supporting a head, the head comprising, in combination:

a) a putter body having a heel, toe, and sole defining a bottom wall, and a front wall, the body elongated between the heel and toe, and b) the body having at least one recess originating from a rear portion of the putter body and projecting forwardly toward a plane defined by the front wall, c) the body having a second recess sunk in said front wall, there being a face plate which is nonmetallic and having a periphery received in said second recess and bonded to said body, said plate having a forward surface and said second recess extending rearwardly from a plane defined by said forward surface, said plate having a relatively larger height medial portion and relatively lesser height opposite end portions projecting toward the heel and toward the toe, d) and including a shaft bore in said body spaced from each recess and from said face plate.

2. The putter of claim 1 including a looping ridge protruding from said front wall and toward said one recess, for bounding an escutcheon attached to said front wall.

3. The putter of claim 1 wherein said plate medial portion has an upwardly convex upper edge and a downwardly convex lower edge.

4. The putter of claim 3 wherein said end portions have substantially equal heights.

5. The putter of claim 3 wherein said upwardly convex upper edge extends above the levels of said opposite end portions.

6. The putter of claim 5 wherein said downwardly convex lower edge extends below the levels of said opposite end portions.

7. The putter of claim 3 wherein said downwardly convex lower edge extends below the levels of each of said opposite end portion.

8. The putter of claim 1 wherein said opposite end portions have equal heights proximate their ends.

9. The combination of claim 1 including an adhesive bonding the periphery of said plate to said head.

10. The combination of claim 9 wherein said head defines a looping shoulder conforming to the periphery of said plate, and to which said plate periphery is bonded by said adhesive.

11. The combination of claim 1 wherein said face plate medial portion defines a ball striking enlarged sweet spot.

12. A golf putter for use with a putter shaft supporting a head, the head comprising, in combination:

a) a putter body having a heel, toe, and sole defining a bottom wall, and a front wall, the body elongated between the heel and toe, and b) the body having at least one recess originating from a rear portion of the putter body and projecting forwardly toward a plane defined by the front wall, c) the body having a second recess sunk in said front wall, there being a face plate which is nonmetallic and having a periphery received in said second recess and bonded to said body, said plate having a forward surface and said second recess extending rearwardly from a plane defined by said forward surface, said plate having a relatively larger height medial portion and relatively lesser height opposite end portions projecting toward the heel and toward the toe, d) and wherein said end portions each have upper and lower edges which extend in substantially parallel relation.

13. The putter of claim 12 wherein said face plate defines a ball-striking surface spaced forwardly of said one recess.

14. The putter of claim 13 wherein said face plate has a substantially uniform thickness.

15. The putter of claim 14 wherein said face plate consists essentially of a material selected from the group that comprises:

a) elastomer b) synthetic resin c) glass.

16. In a putter head, the combination comprising:

a) a longitudinally elongated putter body in the form of a bar having a rear side, top and bottom walls, a toe and a heel, and a face plate insert having a forward face for striking a golf ball, b) a main recess sunk forwardly in said rear side, and between peripherally weighted toe and heel regions, c) and an undercut recess extending generally parallel to said insert forward face and away from an inner extent of said main recess whereby a reduced thickness plate is formed between said recesses and said forward face and extends rearwardly of said insert, d) said insert being non-metallic.

17. The combination of claim 16 wherein said undercut recess extends toward at least two of the following:

i) said top wall ii) said bottom wall iii) said toe iv) said heel.

18. The combination of claim 16 wherein said undercut recess extends toward at least three of the following:

i ) said top wall ii ) said bottom wall iii ) said heel iv ) said toe.

19. The combination of claim 16 wherein said undercut recess extends toward all four of the following:

i) said top wall ii ) said bottom wall iii ) said heel iv ) said toe.

20. The combination of claim 16 wherein said bottom wall projects rearwardly to a greater extent than said top wall.

21. In a putter head, the combination comprising:

a) a longitudinally elongated putter body in the form of a bar having a rear side, top and bottom walls, a toe and a heel, and a face plate insert having a forward face for striking a golf ball, b) a main recess sunk forwardly in said rear side, and between peripherally weighted toe and heel regional, c) and an undercut recess extending generally parallel to said insert forward face and away from an inner extent of said main recess whereby a reduced thickness plate is formed between said recesses and said forward face and extends rearwardly of said insert, d) said insert being non-metallic, e) and wherein said insert has a relatively larger height medial portion and relatively lesser height opposite end portions projecting toward the heel and toward the toe.

22. The combination of claim 21 wherein said opposite end portions have substantially equal heights along major extents of their lengths.

23. The combination of claim 21 wherein said face plate medial portion defines a ball striking enlarged sweet spot.

24. In a putter head, the combination comprising:

a) a longitudinally elongated putter body in the form of a bar having a rear side, top and bottom walls, a toe and a heel, and a face plate insert having a forward face for striking a golf ball, b) a main recess sunk forwardly in said rear side, and between peripherally weighted toe and heel regions, c) and an undercut recess extending generally parallel to said insert forward face and away from an inner extent of said main recess whereby a reduced thickness plate is formed between said recesses and said forward face and extends rearwardly of said insert, d) and wherein said body forms outwardly convex elongated corners between at least two of the following:

i) said top wall and said forward face ii) said top wall and said rear side iii) said bottom wall and said forward face iv) said bottom wall and said rear side.

25. The combination of claim 24 wherein said corners are formed between at least three of the following:

i) said top wall and said forward face ii) said top wall and said rear side iii) said bottom wall and said forward face iv) said bottom wall and said rear side.

26. The combination of claim 25 wherein said elongated convex corners are generally parallel.

27. The combination of claim 24 wherein said corners are formed between all four of the following:

i) said top wall and said forward face ii) said top wall and said rear side iii) said bottom wall and said forward face iv) said bottom wall and said rear side.

28. The combination of claim 27 wherein said elongated convex corners are spaced from said insert.

29. The combination of claim 24 wherein said bottom wall projects rearwardly to a greater extent than said top wall.

30. The combination of claim 24 wherein said elongated convex corners are generally parallel.

31. The combination of claim 24 wherein a shaft bore extends downwardly in the head, and intersects said top wall and said elongated corner which is formed between said top wall and said forward face.

32. The combination of claim 24 wherein a shaft bore extends downwardly in the head, and has intersection with said top wall, said intersection everywhere located between said elongated corners.

33. In a putter head, the combination comprising a) a longitudinally elongated putter body in the form of a bar having a rear side, top and bottom walls, a toe and a heel, and a face plate insert having a forward face for striking golf ball, b) a main recess sunk forwardly in said rear side, and between peripherally weighted toe and heel regions, c) and an undercut recess extending generally parallel to said insert forward face and away from an inner extent of said main recess whereby a reduced thickness plate is formed between said recesses and said forward face and extends rearwardly of said insert, d) and wherein said bottom wall defines a scoop located centrally of the bar between the head and toe, said scoop diverging toward said rear side, and spaced rearwardly from said forward face.

34. The combination of claim 33 wherein said scoop is in the form of a bevel.

35. The combination of claim 33 wherein said body forms an elongated outwardly convex corner between said bottom wall and said rear side, said scoop intersecting said convex corner.

36. In a putter head, the combination comprising:

a) a longitudinally elongated putter body in the form of a bar having a rear side, top and bottom walls, a toe and a heel, and a face plate insert having a forward face for striking a golf ball, b) a main recess sunk forwardly in said rear side, and between peripherally weighted toe and heel regions, c) and an undercut recess extending generally parallel to said insert forward face and away from an inner extent of said main recess whereby reduced thickness plate is formed between said recesses and said forward face and extends rearwardly of said insert, d) and wherein said rear side is angled downwardly and rearwardly, to provide an upwardly projected visible intersection of the main recess with said angled rear side.

37. The combination of claim 36 including striations on said angled rear side and extending directionally between the toe and heel.

38. In a putter head, the combination comprising:

a) a longitudinally elongated putter body in the form of a bar having a rear side, top and bottom walls, a toe and a heel, and a face plate insert having a forward face for striking a golf ball, b) a main recess sunk forwardly in said rear side, and between peripherally weighted toe and heel regions, c) and an undercut recess extending generally parallel to said insert forward face and away from an inner extent of said main recess whereby a reduced thickness plate is formed between said recesses and said forward face and extends rearwardly of said insert, d) and wherein a shaft bore extends downwardly in the head, from said top wall.

* * * * *